United States Patent [19]

Kirsch

[11] Patent Number: 4,640,026

[45] Date of Patent: Feb. 3, 1987

[54] SKI BOOT WITH RELEASE MECHANISM

[76] Inventor: Bernhard Kirsch, Im Litzelholz 23, 5500 Trier, Fed. Rep. of Germany

[21] Appl. No.: 668,104

[22] Filed: Nov. 5, 1984

[30] Foreign Application Priority Data

Nov. 5, 1983 [DE] Fed. Rep. of Germany ..... 3340051
Aug. 8, 1984 [DE] Fed. Rep. of Germany ..... 3432065

[51] Int. Cl.[4] ..... A43B 5/04; A63C 9/08; A63C 9/088

[52] U.S. Cl. ..... 36/117; 36/120; 280/612; 280/613

[58] Field of Search ..... 36/117-121; 280/611, 612, 613

[56] References Cited

U.S. PATENT DOCUMENTS 3,689,096 9/1972 Ribi ..... 280/613
3,776,566 12/1973 Smolka ..... 280/612
3,947,051 3/1976 Sittmann ..... 280/613 X
4,138,828 2/1979 Kubelka ..... 36/121
4,159,124 6/1979 Salomon ..... 280/612
4,436,321 3/1984 Storandt et al. ..... 280/612
4,494,767 1/1985 Campillo et al. ..... 280/612

FOREIGN PATENT DOCUMENTS 2418655 9/1979 France ..... 280/612

*Primary Examiner*—James Kee Chi
*Attorney, Agent, or Firm*—Ward Brown; Robert W. Beach

[57] ABSTRACT

A release member is pivotally mounted on the heel portion of a ski boot for swinging about a transverse horizontal axis. Control mechanism normally holds the release member in fixed relationship relative to the remainder of the boot for fitting in a safety ski binding but is actuated by force in excess of a predetermined force being exerted on the boot to unlock the release member to allow it to swing so as to release the ski boot from the binding.

9 Claims, 40 Drawing Figures

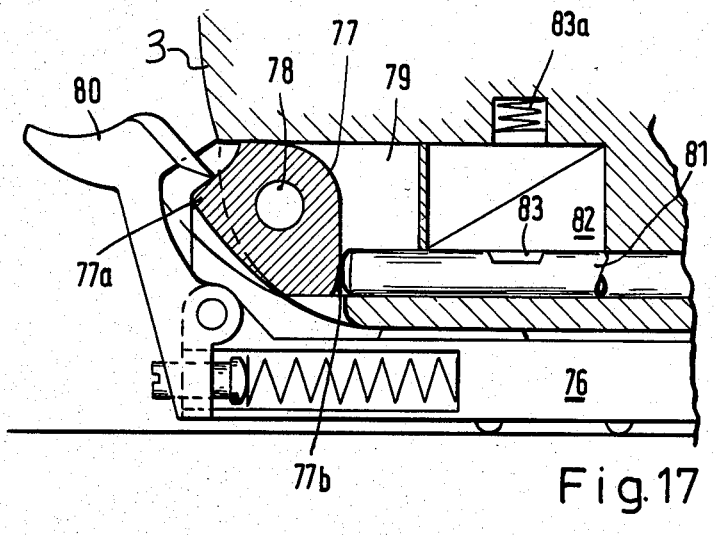
Fig.17
Fig.18
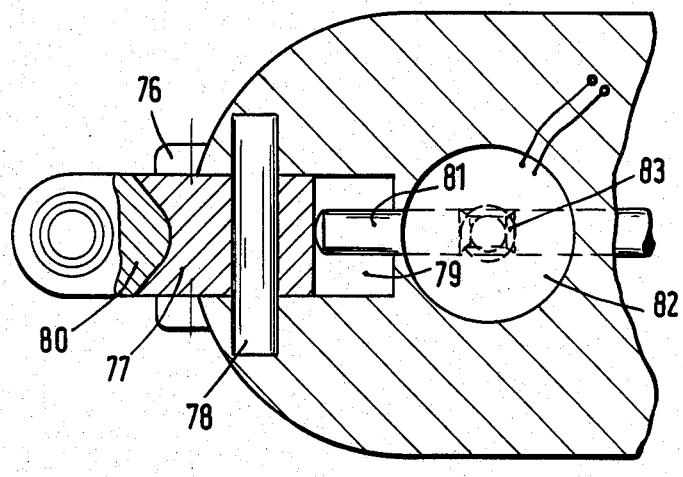

Fig. 24
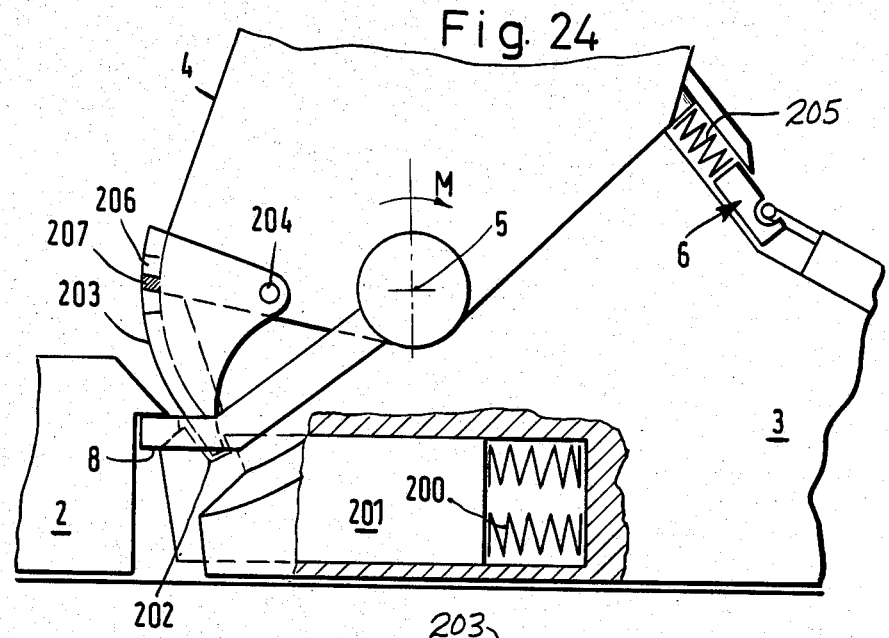
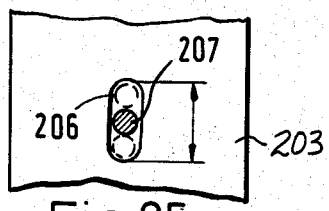
Fig. 25
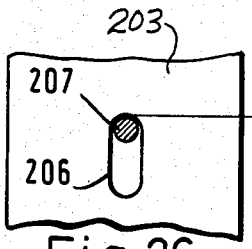
Fig. 26
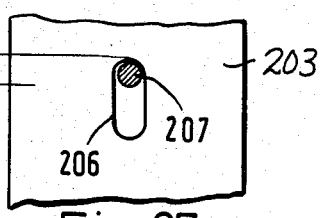
Fig. 27
Fig. 28
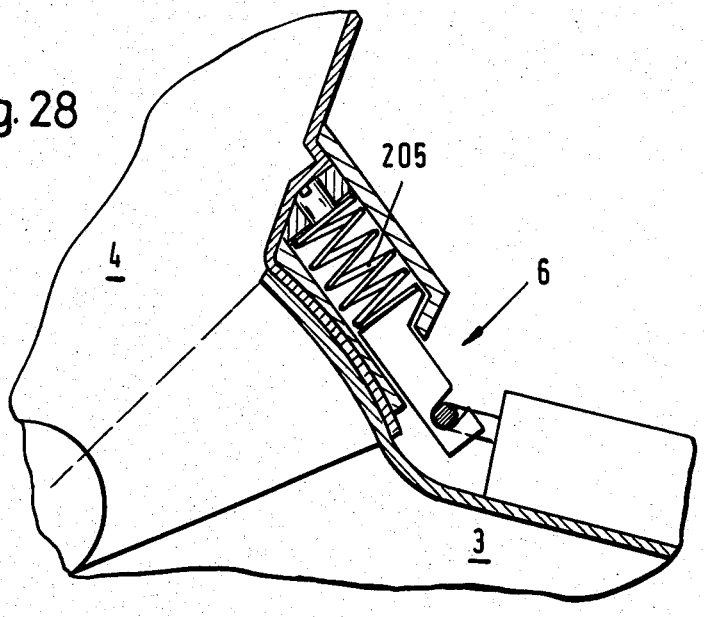

SKI BOOT WITH RELEASE MECHANISM

BACKGROUND OF THE INVENTION

1. Field of the Invention

The present invention relates to a ski boot fittable in a safety ski binding. More specifically, the present invention relates to a ski boot carrying a release member normally fitted in a ski binding but movable relative to the remainder of the boot to release the ski boot from the binding.

2. Prior Art

Known safety ski bindings have toe and heel holding elements hooked over the sole or fixed projections at the front and back of a ski boot. When force in excess of a predetermined force is exerted by the boot on the bindings, such holders move relative to the ski to release the boot. Leg injuries have continued to occur, however, and the search has continued for improved boot-releasing systems.

SUMMARY OF THE INVENTION

It is an object of the present invention to provide novel mechanism for reliably releasing a ski boot from a ski when force in excess of a predetermined force is exerted on the boot.

It also is an object to provide such mechanism in a form adapted to mechanical or electrical or electronic control.

An additional object is to provide such mechanism in a form usable with known safety ski bindings without impairing the release mechanism of such bindings.

In the invention as disclosed, the foregoing objects are accomplished by providing a release member pivotally mounted on a ski boot. Such release member is normally maintained in fixed relationship relative to the remainder of the boot for engagement in a safety ski binding, but is movable to release the boot from the binding when force in excess of a predetermined force is detected.

In the preferred embodiment, the release member is pivotally mounted on the heel portion of the boot for swinging about a horizontal transverse axis, namely, the same axis about which an ankle portion of the boot can swing relative to a foot portion. In its locked position, the release member extends rearward beyond the ski boot sole for engagement in the heel binding.

BRIEF DESCRIPTION OF THE DRAWINGS

FIG. 17 is a diagrammatic, fragmentary, side elevation of the heel portion of yet another modified form of a ski boot with release mechanism in accordance with the present invention and the upper surface and heel binding of a ski; and FIG. 18 is a diagrammatic, fragmentary, top plan of the heel portion of the ski boot and heel binding shown in FIG. 18; parts being broken away in both figures.

FIG. 24 is a diagrammatic, fragmentary, side elevation of the heel portion of the ski boot shown in FIG. 23 and the upper surface and heel binding of a ski, with parts broken away; FIGS. 25, 26 and 27 are corresponding, diagrammatic, enlarged, fragmentary, rear end elevations of a portion of the ski boot shown in FIGS. 23 and 24, with parts in different positions; and FIG. 28 is a diagrammatic, enlarged, fragmentary side elevation of a central instep portion of the ski boot shown in FIGS. 23 and 24, with parts broken away.

DETAILED DESCRIPTION

A ski boot with release mechanism in accordance with the present invention is intended to be used with conventional ski bindings for normally holding the toe and heel portions of the ski boot on a ski. Such conventional bindings can have known mechanically releasable elements causing one or the other or both of the bindings to move relative to the ski to release the boot when force in excess of a predetermined force is exerted by the boot on the bindings. In a conventional boot, such bindings hook over the sole or fixed projections at the front and back of the boot. The improved ski boot in accordance with the present invention has a boot-mounted release member engageable by a binding and normally locked in fixed relationship to the remainder of the boot. Force-actuated control mechanism, which also is carried by the boot, triggers unlocking of the release member, allowing such release member to move and thereby release the boot, regardless of whether or not the bindings, themselves, have been tripped. Nevertheless, if the release mechanism of the present invention fails for any reason, the mechanically-releasable safety ski bindings still are effective to release the boot.

Figure 1:
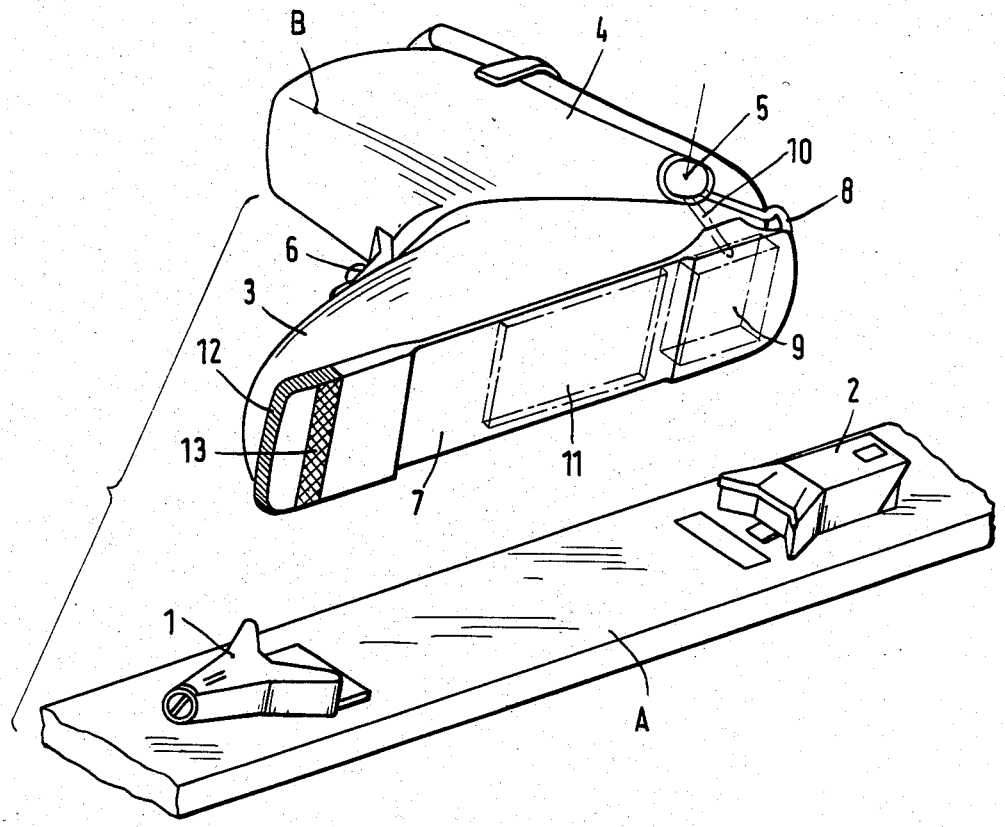
FIG. 1 is a diagrammatic top perspective illustrating a ski boot with release mechanism in accordance with the present invention, with some parts deleted, and a fragment of a ski having conventional front and rear bindings.

In the embodiment shown diagrammatically in FIG. 1, the ski A carries conventional, mechanically releasable front and rear bindings 1 and 2, respectively, for the ski boot B in accordance with the present invention. Such ski boot has a lower foot-enclosing portion 3 and an upper ankle-encircling portion 4. The ankle portion of the boot is swingable relative to the foot portion about the transverse horizontal axis 5 of pins connecting such two portions. Such pins are located in the heel region of the boot. The two boot portions can be locked in the vorlage skiing position by locking mechanism 6 mounted generally over the instep, but can be unlocked to allow relative swinging movement for more comfortable walking.

Figure 2:
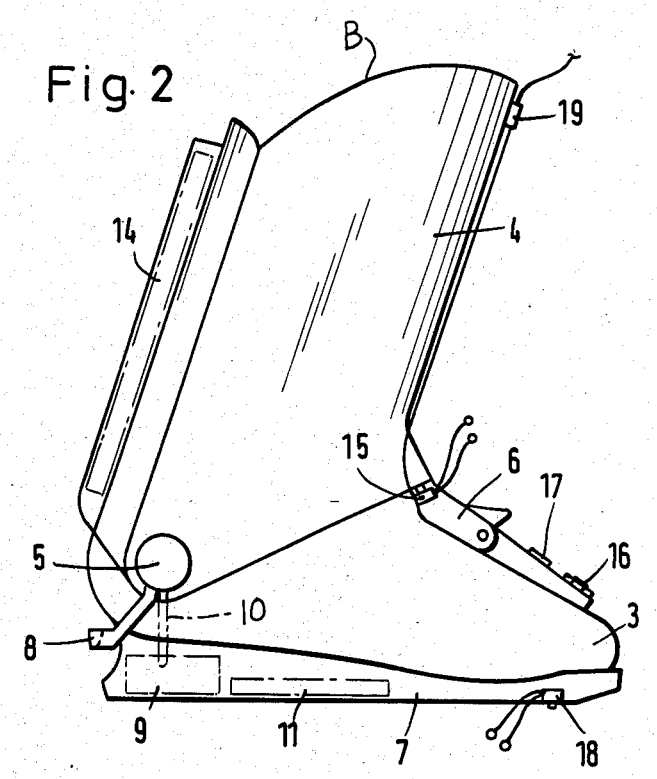
FIG. 2 is a diagrammatic side elevation of the ski boot shown in FIG. 1, with some parts deleted.

The leading tip or toe portion of the boot sole 7 projects forward for engagement by the front binding 1. At the rear of the boot, a release member 8, in the form of a yoke swingable about the axis 5, projects rearward beyond the rear end of the sole 7 for engagement in the heel binding 2. Levers 10 project downward generally from the axis 5 and are swingable with the release member 8. As best seen in FIG. 2, the bottom tip portions of the levers 10 are engaged in release control mechanism 9 carried inside the sole 7 below the heel of the skier. Such release mechanism normally maintains the levers 10 and, consequently, the release member or yoke 8 in the position shown in FIG. 2, in which position the release member is hooked in the rear ski binding for holding the ski boot on the ski.

An electronic control unit 11 is mounted in the boot sole ahead of the release control mechanism 9. Such control unit is operable to trigger the release control mechanism 9 to unlock the levers 10 and thereby permit downward and forward swinging movement of the release member 8 so as to release the ski boot from the heel binding. Preferably the electronic control unit 11 receives signals from force-sensing devices such as the force-actuated switches 12 and 13 shown diagrammatically in FIGS. 1 and 4. Alternatively, the force-sensing devices can be pressure cells or wire strain gauges, for example.

Switch 12 mounted in the toe of the sole senses the forward force exerted by the ski boot sole against the front binding 1. Switch 13 mounted in the bottom of the boot sole senses the downward force exerted by the toe portion of the boot sole against the upper surface of the ski. If the forward-directed force sensed by switch 12 or the downward-directed force sensed by switch 13 is in excess of a predetermined force, a signal is sent to the electronic control unit 11 to trigger the release control mechanism 9 to unlock the release levers 10.

Figure 4:
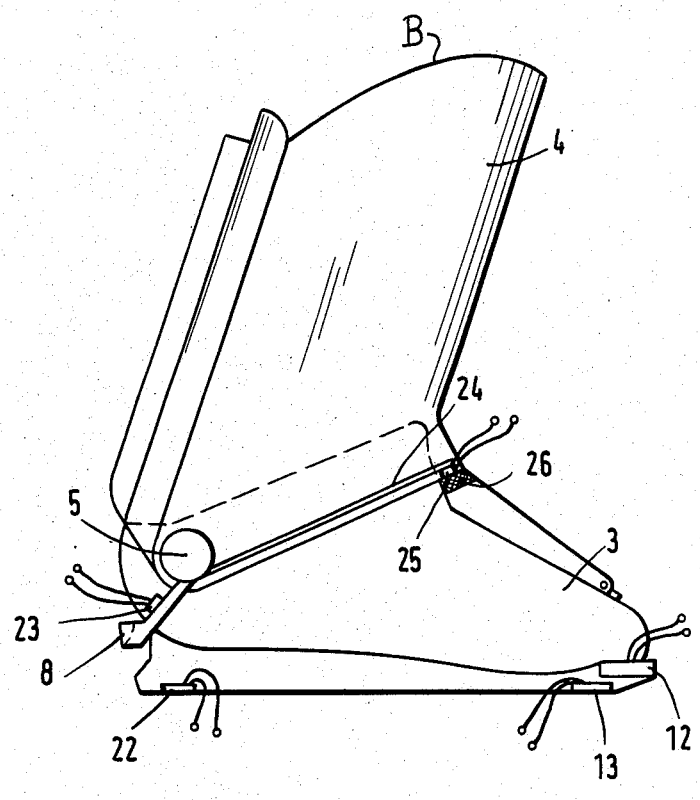
FIG. 4 is a diagrammatic side elevation of the ski boot of FIGS. 1 and 2, with some parts deleted.

As diagrammatically indicated in FIG. 4, additional force-sensing devices can be used, including a force-actuated switch 22 mounted in the bottom of the boot sole adjacent to the heel to sense downward force exerted by the rear portion of the boot sole against the upper surface of the ski and a force-actuated switch 23 which can be carried by the release member 8 in position to be engaged against the heel binding 2 for sensing upward or rearward force exerted against the heel binding. Further, another force-sensing device can be provided to detect the rotational force or moment tending to swing the boot ankle portion 4 forward relative to the boot foot portion 3. In the embodiment shown in FIG. 4, a rigid strap 24 is looped over the instep portion of the boot from the pins connecting the ankle portion 4 and the foot portion 3. A force-sensing device 25 is mounted in the instep region on a layer 26 of resilient material for engagement by strap 24 to detect the rotational force tending to swing the boot ankle portion 4 about the axis 5 and signal the electronic control unit 11 if such force exceeds a predetermined force.

Other force-sensing devices can be provided to detect transversely directed forces.

Preferably, each of the various force-sensing devices operates independently so that different predetermined forces are effective to actuate release of the boot from the heel binding depending on the direction of the force sensed by such device.

As shown in FIG. 2, electrical power for the electric and electronic parts of the boot can be provided by a battery 14 mounted on the rear of the boot ankle or leg portion 4. The circuitry can include a main switch 15 to control whether or not power is supplied to the other electrical components and closed automatically whenever the ankle and foot portions are locked in the vorlage skiing position by the locking mechanism 6. A push-button switch 17 can be mounted over the toe portion of the boot where it can be conveniently pushed by a ski pole to actuate an electronic visual display 16 to indicate the condition of the battery. In addition, another push-button switch 18 connected in series with switch 15 can be mounted in the sole of the boot and have a depressable button extending below the sole so that such switch 18 is closed only when the ski boot is held on the ski.

Figure 3:
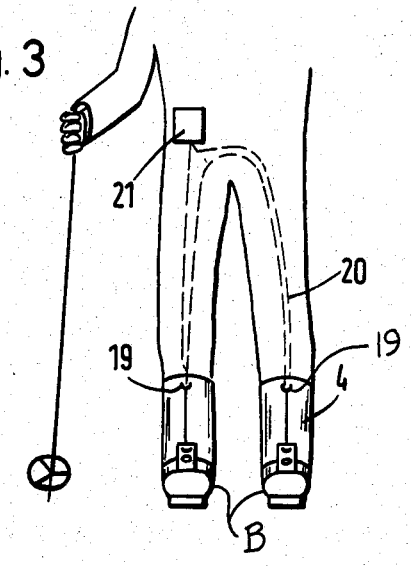
FIG. 3 is a diagrammatic front elevation of the lower body of a person wearing a pair of ski boots of the type shown in FIGS. 1 and 2.

As indicated in FIG. 3, another battery 21 can be carried at any convenient location on or in the clothing of the skier. Battery 21 is connected to the release circuit of each boot by leads 20 through disconnectable plugs and sockets 19 carried at the top front portion of each boot. Preferably, the circuits for the two boots are interconnected by the leads 20 so that if the release control mechanism of one boot is actuated to unlock the release member 8, the release control mechanism of the other boot also will be actuated.

Figure 5:
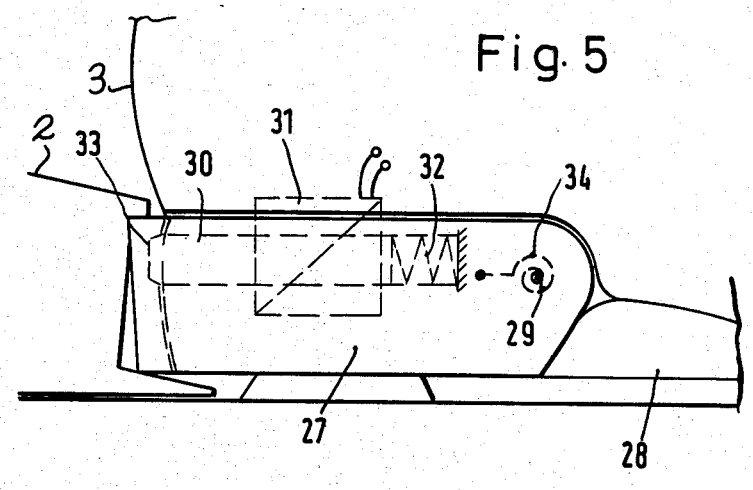
FIGS. 5 and 6 are corresponding, diagrammatic, fragmentary, side elevations of the lower rear corner or heel portion of a modified ski boot with release mechanism in accordance with the present invention and the upper surface and rear or heel binding of a ski, with parts in different positions to illustrate the locked and unlocked positions of the release mechanism of such boot.
Figure 6:
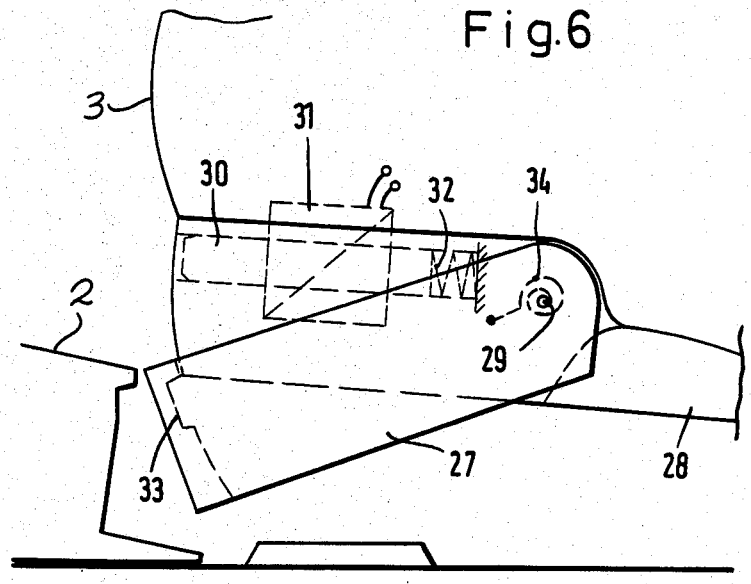

In the embodiment shown in FIGS. 5 and 6, the release member 27 is a rigid U-shaped strip looped around the rear end of and extending rearward beyond the boot sole 28. The opposite ends of such release member are pivoted to the boot sole for swinging about the horizontal transverse axis 29 in the sole. The control mechanism for the release member includes a horizontal retaining bar or plunger 30 normally extending through the rear of the boot sole and fitted in a notch 33 in the inner side of the rear portion of the release member 27, as shown in FIG. 5. In such position the plunger prevents the release member from swinging relative to the remainder of the boot, so that the release member and the boot are firmly held in the heel binding 2. The plunger 30 is biased to its projected position shown in FIG. 5 by a compression spring 32.

If a release signal is received from one of the force-sensing devices, an electromagnet 31 is actuated to move the plunger 30 inward against the force of the compression spring 32. As indicated in FIG. 6, such inward movement of the plunger frees the release member 27 for downward swinging and thereby releases the ski boot from the heel binding 2. A spiral spring 34 connected between the release member and the boot sole returns the release member to the position shown in FIG. 5.

Figure 7:
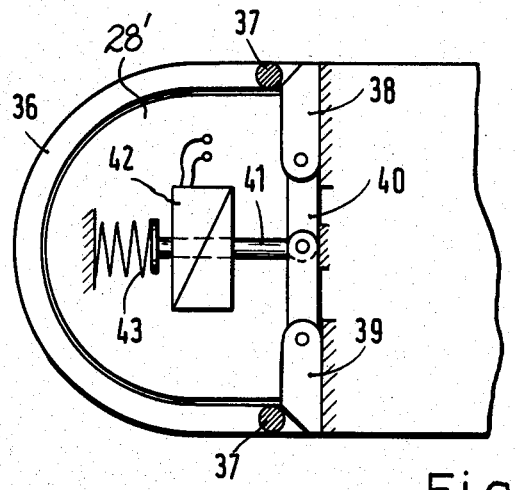
FIGS. 7 and 8 are corresponding, diagrammatic, fragmentary, top plans of the rear or heel portion of another modified ski boot with release mechanism in accordance with the present invention, with parts in different positions, parts being broken away in both figures to illustrate the release control mechanism of such boot.
Figure 8:
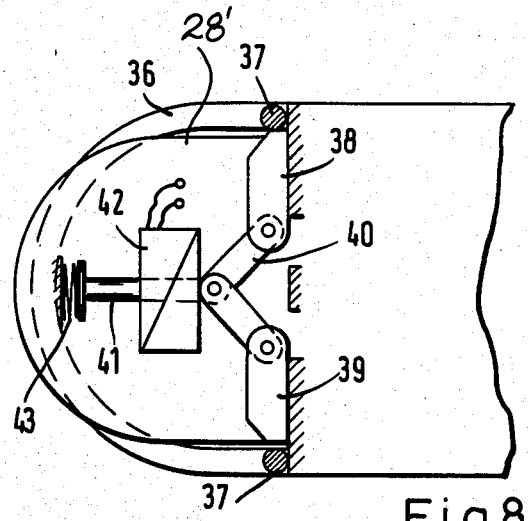

In the embodiment shown in FIGS. 7 and 8, the release member 36 and the heel portion 28' of the boot sole are shaped approximately the same as the release member 27 and boot sole 28 shown in FIGS. 5 and 6. Rather than being pivoted directly to the boot sole, however, the release member 36 shown in FIGS. 7 and 8 has arms 37 extending upward, toward the viewer as viewed in FIGS. 7 and 8, at the forward ends of the release member. The upper end portions of the arms 37 are pivoted to the heel region of the ski boot for swinging about a transverse horizontal axis located in approximately the same position as the axis 5 shown in FIG. 1. In the locked position shown in FIG. 7, the release member 36 fits in the ski heel binding to hold the ski boot on the ski.

Retaining or abutment bars or blocks 38 and 39 normally project transversely from the opposite lateral sides of the ski boot sole 28' directly in front of the opposite ends of the release member 36, as shown in FIG. 7, to prevent downward swinging movement of the release member. Such abutment blocks 38 and 39 are guided for inward movement transversely of the ski boot sole.

The inner ends of the abutment blocks 38 and 39 are pivotally connected to a toggle linkage 40. The knee of such linkage is pivotally connected to the leading end portion of a plunger 41 biased forward to project the abutment blocks from the ski boot sole by a compression spring 43. When any of the force-sensing devices signals the electronic control unit of the boot, an electromagnet 42 is actuated to move the plunger rearward to the position shown in FIG. 8, thereby withdrawing the abutment blocks 38 and 39 into the ski boot sole. Such inward movement of the abutment blocks frees the release member 36 for swinging downward to the position indicated in FIG. 8, away from the viewer as viewed in that figure, to release the ski boot from the binding.

Figure 9:
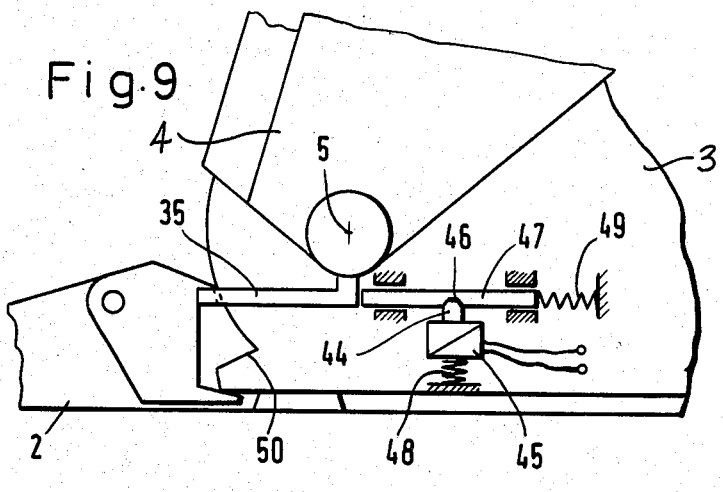
FIGS. 9 and 10 are corresponding, diagrammatic, fragmentary, side elevations of the heel portion of still another modified ski boot with release mechanism in accordance with the present invention and the upper surface and heel binding of a ski, with parts in different positions, parts being broken away in both figures to illustrate the release control mechanism of such boot.
Figure 10:
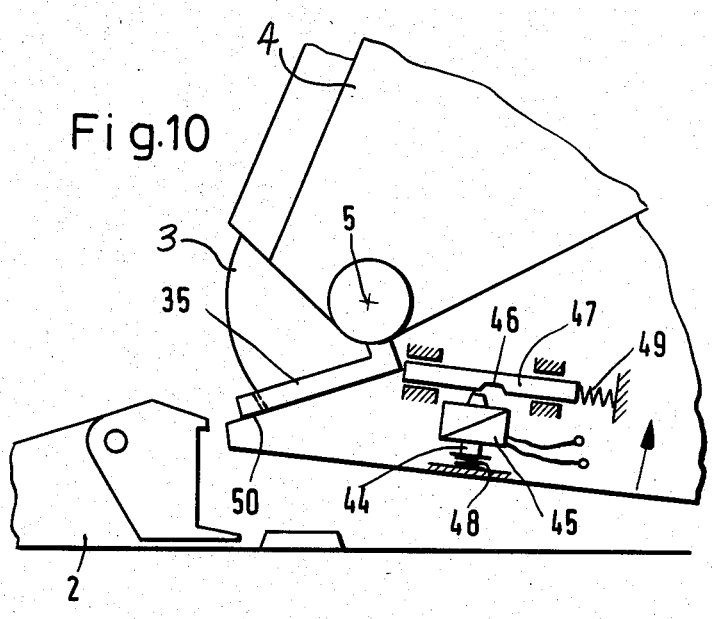

In the embodiment shown in FIGS. 9 and 10, the release member 35 is in the form of a yoke having its opposite ends extending upward and swingable about the horizontal transverse axis 5 in the heel region of the boot. The rear or looped portion of the release member extends beyond the rear end of the ski boot sole for fitting in the ski heel binding 2. A longitudinally-extending retaining bar 47 normally blocks downward swinging movement of the release member 35 and is biased to its locking position shown in FIG. 9 by a compression spring 49. Such retaining bar 47 has a downward-opening notch 46 in its central portion which normally receives the upper end portion of an upright plunger 44 biased upward by a compression spring 48. Actuation of an electromagnet 45, when one or more of the force-sensing devices sends a release signal, is effective to move the plunger 44 downward which frees the retaining bar 47. The bar moves forward against the force of spring 49 as the release member 35 swings downward and inward to the position shown in FIG. 10 to release the boot from the heel binding 2. It will be noted that the lower portion of the ski boot sole has a recess 50 into which the release member 35 swings as the boot is released from the binding.

Figure 11:
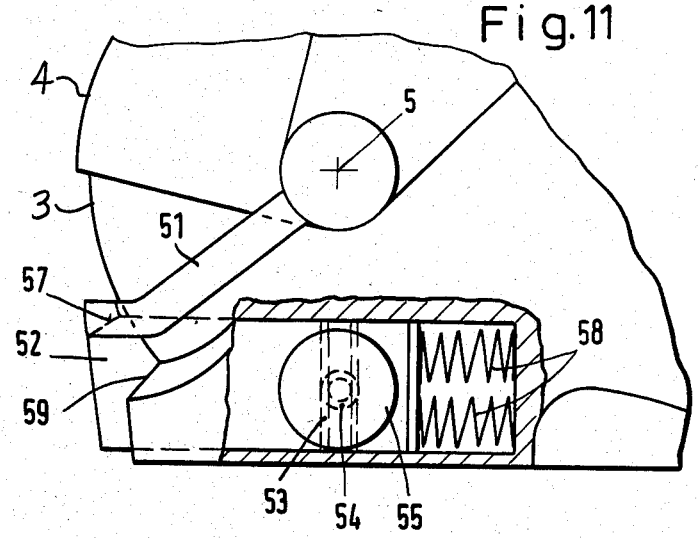
FIG. 11 is a diagrammatic, fragmentary, side elevation of the heel portion of yet another modified ski boot with release mechanism in accordance with the present invention, with parts broken away.
Figure 12:
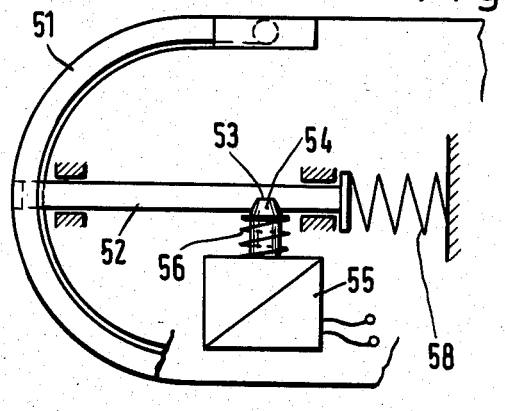
FIG. 12 is a diagrammatic, fragmentary, top plan of the heel portion of the ski boot shown in FIG. 11, with parts broken away.

In the embodiment shown in FIGS. 11 and 12, the release member 51 projects rearward beyond the rear end of the ski boot sole and is swingable about the horizontal transverse 5 in the heel region of the boot. An upright retaining bar or plate 52 normally projects rearward from the ski boot sole beneath the rear end portion of the release member 51 to prevent it from swinging. Such locking plate is movable forward against the force of compression springs 58, but is normally held in its rearward-projecting locking position by the tip of a horizontal plunger 54 fitted in a notch 53 in an upright side of the plate. Such plunger is biased to its locking position by a compression spring 56 best seen in FIG. 12. Upon receipt of a release signal, an electromagnet 55 is actuated to withdraw the plunger against the force of its return spring 56 so that the release member 51 can swing downward into a recess 59 in the ski boot sole to release the boot, while forcing the locking plate 52 inward against the force of its return springs 58.

Figure 13:
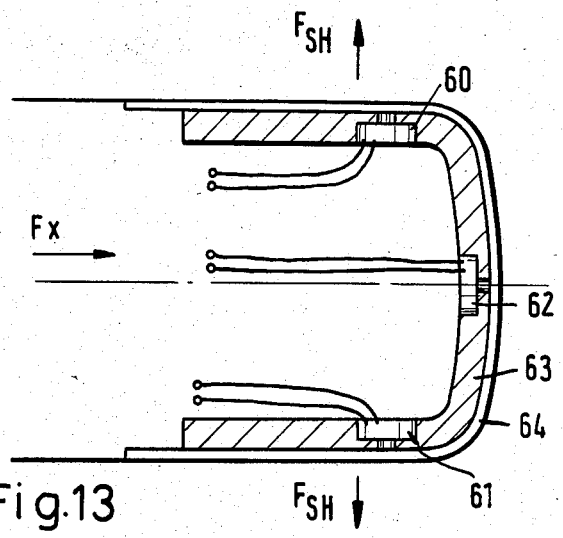
FIG. 13 is a diagrammatic, fragmentary, top plan of the front or toe portion of a ski boot with release mechanism in accordance with the present invention, with parts broken away to illustrate the force-sensing devices controlling the release mechanism of such boot.

FIG. 13 illustrates somewhat diagrammatically how separate force-sensing devices 60, 61 and 62 can be mounted in the toe portion of a ski boot in accordance with the present invention. The toe of the boot has a spring steel rim 64 surrounding a layer 63 of resilient material resisting inward bending movement or flexing of the rim. Force-sensing devices 60 and 61 are mounted in such layer 63 at opposite sides of the ski boot toe to detect primarily transversely directed forces in the direction of the arrows $F_{SH}$. Another force-sensing device 62 is mounted in the toe of the boot to detect primarily longitudinally directed forces in the direction of the arrow $F_x$. Obliquely directed forces applied to the steel rim 64, however, move it inward against the resisting force of the resilient layer 63 and can also actuate the sending of a release signal by one or more of the force-sensing devices 60, 61 and 62. The force-sensing devices can be force-actuated switches which are closed when the selected predetermined force is exceeded so as to supply power from the boot battery to the electronic control unit or directly to the electrically-actuated release control mechanism.

Figure 14:
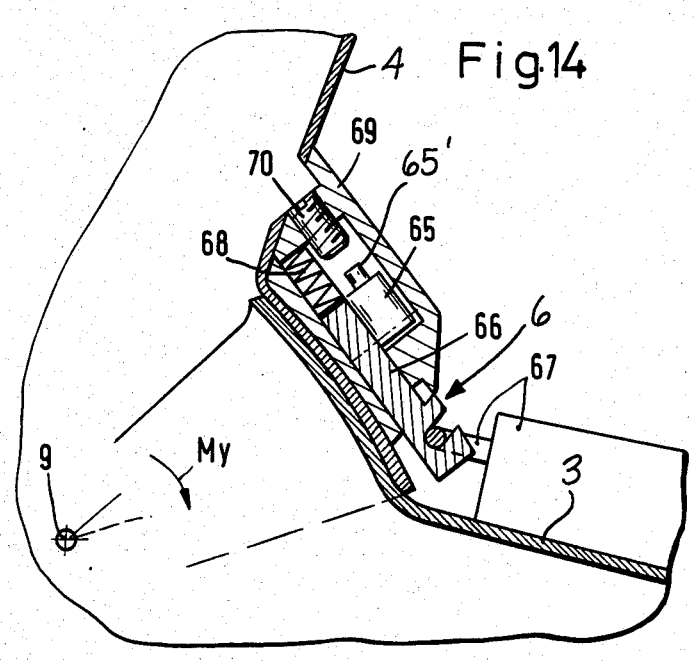
FIG. 14 is a diagrammatic, fragmentary, side elevation of a central instep portion of a ski boot with release mechanism in accordance with the present invention, with parts broken away.

FIG. 14 illustrates the mounting of a force-actuated microswitch 65 in generally the instep region of the ski boot to detect the moment $M_y$ tending to swing the boot ankle portion 4 relative to the boot foot portion 3. As shown in FIG. 14, such two portions are pivoted to each other for swinging about a horizontal transverse axis 9 in the area of the heel region of the boot. A locking block and pin 67 are secured on the upper surface of the boot foot portion 3. The locking pin projects rearward and fits in the hooked end of an inclined slide plate 66 movable longitudinally in a block 69 fitted on the lower end portion of the boot ankle part 4. Such slide plate is biased generally downward to the position shown in FIG. 14 by a compression spring 68. If the upper boot part 4 swings downward against the force of the compression spring 68, the button 65' of the microswitch is engaged by the inner end of a set screw 70 aligned with it, to close the switch and actuate a release signal. The release force or moment can be adjusted by turning the set screw.

Figure 15:
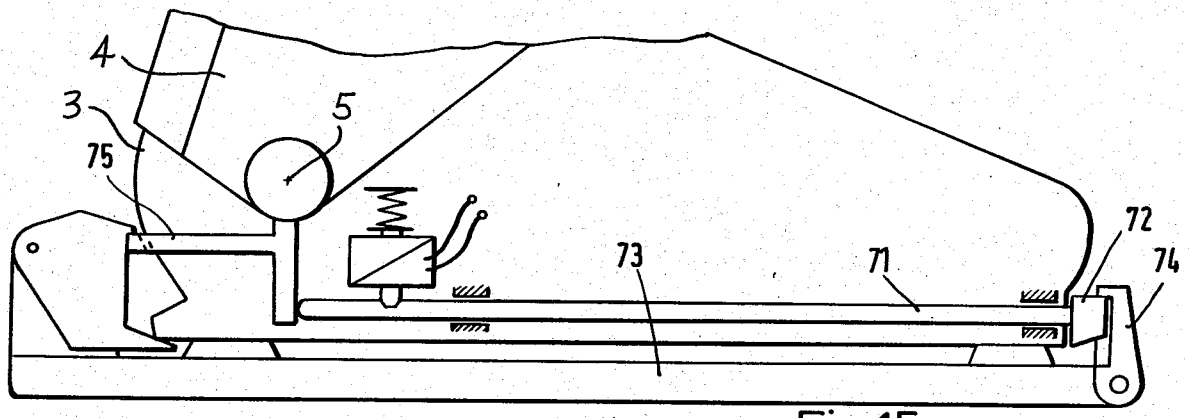
FIGS. 15 and 16 are corresponding, diagrammatic, fragmentary, side elevations of primarily the bottom or foot portion of another modified form of a ski boot with release mechanism in accordance with the present invention and the central portion and bindings of a ski, with parts in different positions, parts being broken away to illustrate the release control mechanism of such boot.
Figure 16:
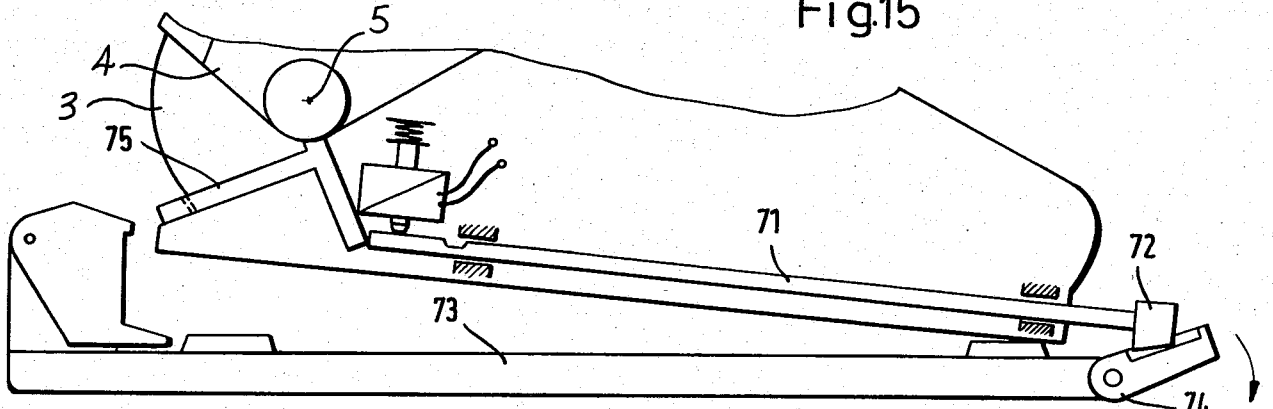

The embodiment shown in FIGS. 15 and 16 is similar to the embodiment shown in FIGS. 9 and 10. Downward swinging movement of the release member 75 into a recess in the ski boot sole is normally prevented by a longitudinally extending retaining bar or plate 71 which, in turn, is normally held in its locking position shown in FIG. 15 by the plunger of an electromagnet projecting into a notch in such plate. In the embodiment of FIGS. 15 and 16, however, the plate 71 extends forward through the toe portion of the ski boot sole and carries an abutment 72 normally fitted in the front portion or toe holder 74 of a safety ski binding 73. When a release signal results in actuating the electromagnet to withdraw its plunger, the release member 75 swings downward as the boot heel is released, and the retaining plate 71 is forced forward to trip the toe holder 74 of the ski binding so that a total release of the boot is assured.

FIGS. 17 and 18 illustrate a special ski binding 76 designed for use with a ski boot having release mechanism in accordance with the present invention. The rear, heel-holding portion 80 of the ski binding normally engages over the rearward-projecting, concave, upper rear quadrant **77*a* of an eccentric cam 77. The cam is rotatably mounted in a recess 70 in the boot sole by a horizontal, transversely-extending pin 78. The lower front quadrant 77*b* of the cam forms an abutment normally engaged against the rear end of a longitudinally-extending retaining bar or rod 81 to prevent rotation of the cam. Rod 81 is slidable fore-and-aft in the ski boot sole and has an upward-extending notch which, in the rearward-shifted locking position of the rod, is aligned with a plunger 83 normally biased downward into the notch by a compression spring 83*a*. If a release signal is received by an electromagnet 82, the plunger 83 is withdrawn so as to permit forward sliding movement of the rod 81. Such forward movement of the rod allows the cam to rotate counterclockwise as viewed in FIG. 17, thereby releasing the heel of the boot from the holder 80 of the ski binding 76**.

As seen in FIG. 18, in the locked position of the cam 77 the ski binding heel holder 80 fits in a central depression in the rearward-projecting portion of the cam. Consequently, the heel of the ski boot is normally held firmly in the binding and cannot slide transversely relative to the binding.

Figure 19:
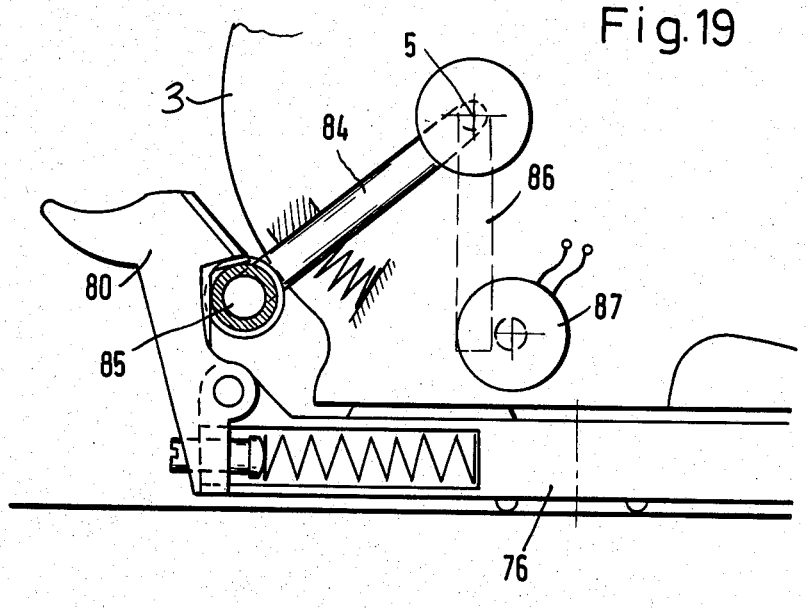
FIG. 19 is a diagrammatic, fragmentary, side elevation of the heel portion of yet another modified form of a ski boot with release mechanism in accordance with the present invention.
Figure 20:
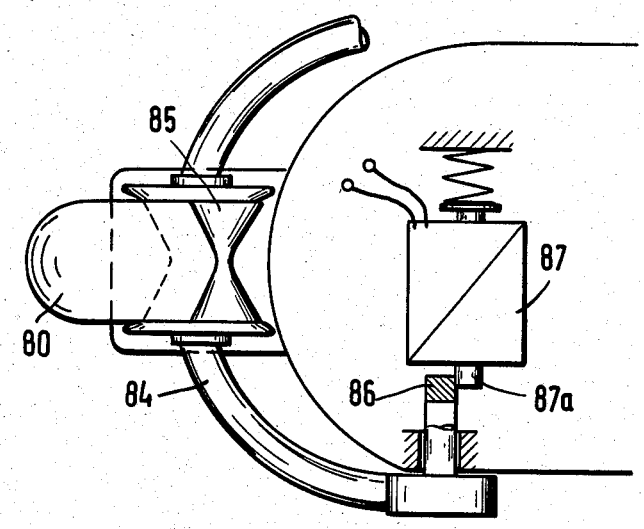
FIG. 20 is a diagrammatic, fragmentary, top plan of the heel portion of the ski boot and the heel binding shown in FIG. 19; parts being broken away in both figures.

The binding 76 and hooked heel holder component 80 shown in FIGS. 19 and 20 are identical to the corresponding parts of the embodiment shown in FIGS. 17 and 18. Similar to the embodiment shown in FIG. 2, the ski boot release member 84 is in the form of a yoke looped around the heel portion of the boot, swingable about the horizontal transverse axis 5 and having a lever 86 projecting downward from such axis and swingable with the release member. The rear portion of the release member 84 carries a roller 85 which, as shown in FIG. 20, decreases in diameter toward its center so as to form a depression in which the heel holder 80 is fitted. In the locked position of the release member shown in FIGS. 19 and 20, downward and forward swinging of the release member is prevented by the retaining bar or plunger **87*a* blocking forward swinging movement of the release member lever 86. When a release signal is received by an electromagnet 87, the plunger 87*a*** is withdrawn so that the release member is free to swing and the heel portion of the ski boot can emerge upward out of the binding.

Figure 21:
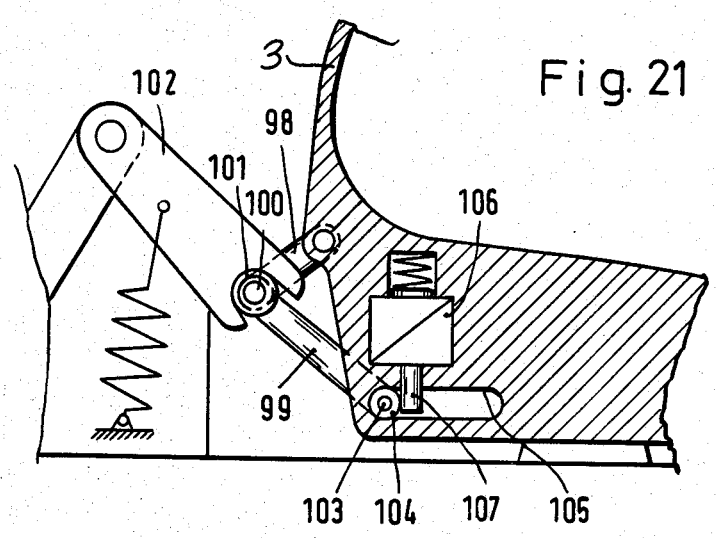
FIGS. 21 and 22 are corresponding, diagrammatic, fragmentary, side elevations of the heel portion of yet another modified form of a ski boot with release mechanism in accordance with the present invention and the upper surface and heel binding of a ski, with parts broken away and parts in different positions.
Figure 22:
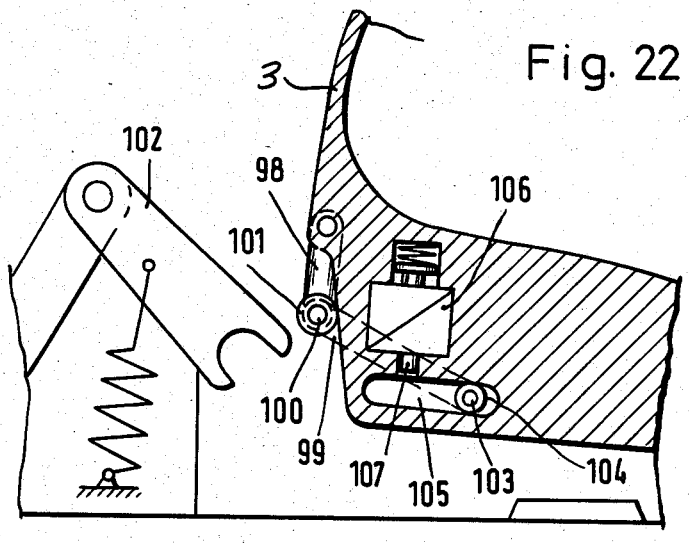
Figure 23:
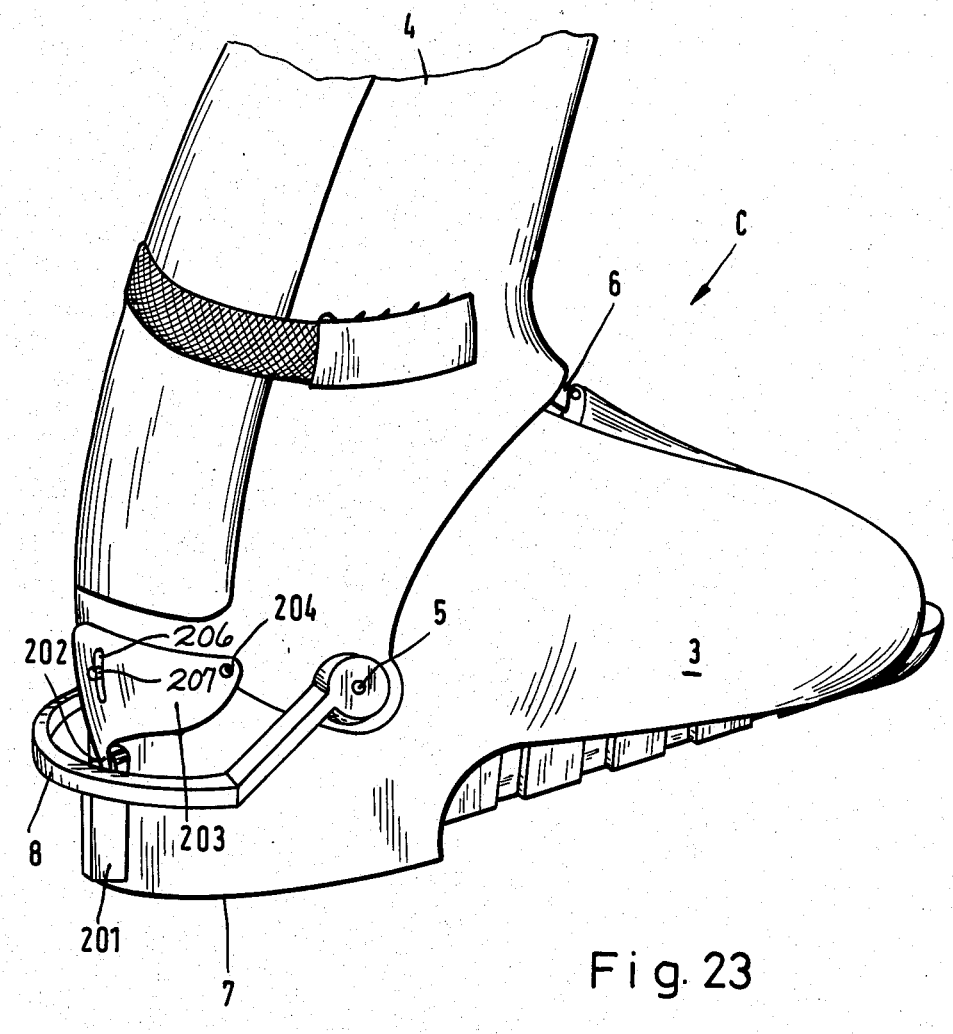
FIG. 23 is a diagrammatic top perspective of yet another modified form of a ski boot with release mechanism in accordance with the present invention, with the top, leg-encircling portion of such boot broken away.

In the embodiment shown in FIGS. 21 and 22, the heel binding includes a downward and forward inclined lever arm 102 having a semicircular notch in its lower end. In the locked position of the ski boot shown in FIG. 21, such notch receives a roller 101 rotatable about a horizontal transverse axis 100 at the swinging end portion of a downward and rearward inclined link 98. Such link is pivoted to the rear end portion of the ski boot sole, forward and above the lower end of the heel binding lever 102. Another link 99 pivotally connected to the swinging end portion of link 98 extends forward and downward from generally the roller axis 100. The lower end portion of such link 99 carries a roller 104 rotatable about an axis 103. The roller is fitted in a longitudinally-extending slot 105 through the bottom portion of the ski boot sole. In the position shown in FIG. 21, rotation of link 98 and forward movement of link 99 is prevented by a retaining bar or plunger 107 extending downward into the boot sole slot 105 immediately forward of the roller 104. Upon receipt of a release signal, an electromagnet 106 withdraws the plunger so that links 98 and 99 are movable forward to the position shown in FIG. 22 in which roller 101 is withdrawn from the notch of heel binding 102 and the heel portion of the ski boot can emerge upward out of the heel binding.

In the embodiment shown in FIGS. 23 through 28, as in the embodiment shown in FIGS. 1 through 4, the ski boot C includes a foot-enclosing portion 3 and an ankle-enclosing portion 4 swingable relative to each other about a horizontal transverse axis 5 in the heel region of the boot. Locking mechanism 6 is operable to lock the ankle portion 4 of the boot relative to the foot portion 3. The release member 8 is in the form of a U-shaped yoke looped around and extending rearward beyond the ski boot sole 7 and swingable about the horizontal transverse axis 5.

Similar to the embodiment shown in FIGS. 11 and 12, an upright retaining bar or plate 201 normally projects rearward from the ski boot sole beneath the rear end portion of the release member 8 to prevent it from swinging downward. Such plate is biased to its rearward-projecting position by compression springs 200.

Rather than providing electrically-controlled mechanism for releasing the upright retaining plate 201, the rear end portion of such plate has an upward opening notch 202 normally receiving the downward-projecting portion of a rigid plate 203 looped around the heel end portion of the boot. Plate 203 is pivotally mounted on the boot ankle portion 4 for swinging about a horizontal transverse axis 204 spaced rearward from the axis 5. A vertical slot 206 through the rear portion of such plate receives a pin 207 projecting from the rear of the boot ankle portion 4.

As best seen in FIG. 28, the locking mechanism 6 mounted on the instep portion of the boot includes a compression spring 205 resisting forward swinging of the boot ankle portion 4 relative to the foot portion 3.

In the position shown in FIG. 24, which corresponds to the position shown in FIG. 25, the pin 207 projecting from the boot ankle portion is approximately centered in the vertical slot 206 of plate 203. Forward swinging of the boot ankle portion relative to the boot foot portion against the force of the compression spring 205 moves the pin 207 upward in its slot 206 to the position shown in FIG. 26. Any additional forward swinging of the boot ankle portion 4 relative to the foot portion 3 also swings the plate 203 upward, as indicated in FIG. 27, which withdraws the downward-projecting portion of the plate from the notch 202 of the upright retaining plate 201, so that such plate 201 can move forward and permit downward-swinging movement of the release member 8 to release the boot heel from the heel binding 2. Consequently, a moment M about the horizontal transverse axis 5 greater than a predetermined moment results in releasing the heel portion of the boot from the binding.

In the position shown in FIG. 25, however, even without releasing the locking mechanism 6 some fore-and-aft swinging of the boot ankle portion 4 relative to the foot portion 3 is permitted for comfortable walking.

In the embodiment shown in FIGS. 29 and 30, the release member is formed by the rear heel portion 208 of the ski boot sole which is swingable relative to the front portion of the sole about a horizontal transverse axis 209 substantially directly below the heel of the skier. Such sole portion 208 extends rearward beyond the heel-enclosing portion of the ski boot for fitting in the ski heel binding. Heel portion 208 of the ski boot sole is biased upward and rearward to the position shown in FIG. 29 by a compression spring 210 engaged between such sole heel portion 208 and the forward portion of the ski boot sole.

The sole heel portion 208 has an upward-opening recess 211 undercut along its leading end portion for receiving the forwardly-curved, hooked end portion 212 of a downward-projecting extension from the boot ankle-encircling portion 4. Such hooked end portion forms a retaining bar normally preventing swinging movement of the sole heel portion 208.

Figure 29:
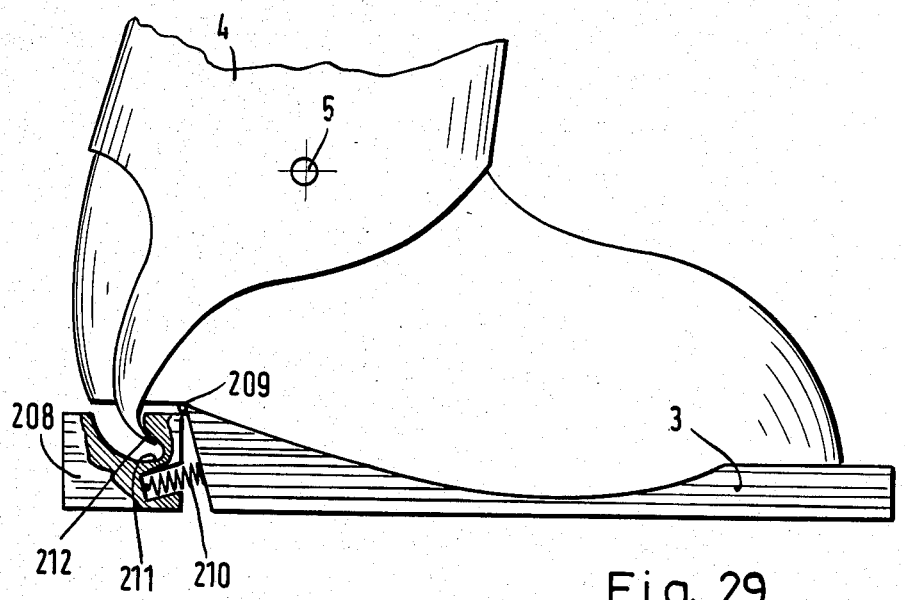
FIGS. 29 and 30 are corresponding, diagrammatic, side elevations of the foot and ankle portions of yet another modified form of a ski boot with release mechanism in accordance with the present invention, with parts in different positions and parts broken away.
Figure 30:
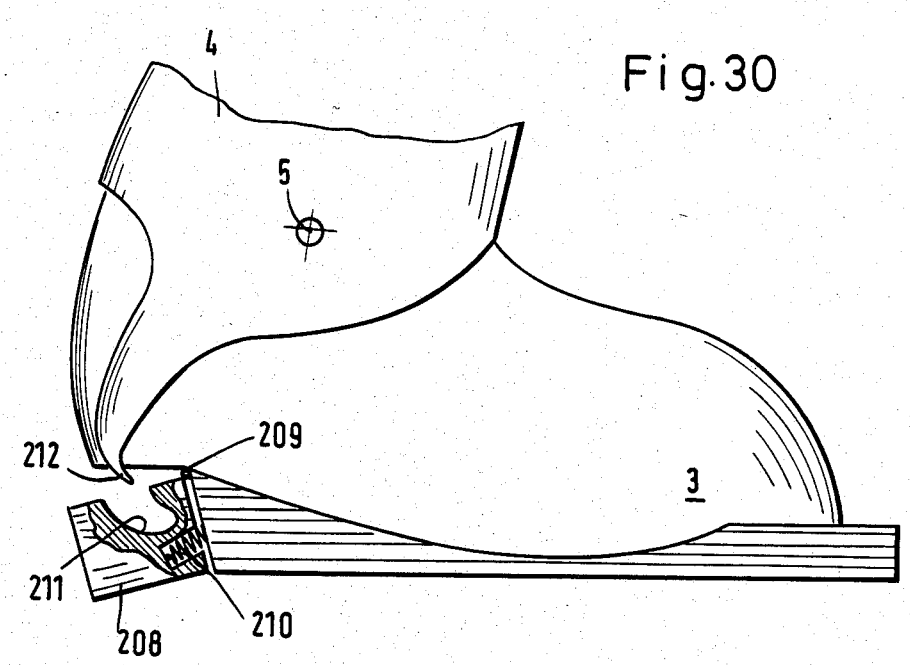

In the locked skiing position shown in FIG. 29, the sole heel portion 208 cannot swing downward because of engagement of the projection 212 in the recess 211. If the ankle portion of the boot 4 swings forward, however, that is, if the moment about axis 5 is greater than a predetermined moment, the projection 212 swings out of the recess 211 so that the heel portion 208 of the ski boot sole can swing downward and forward as the boot is released from the heel binding.

Figure 31:
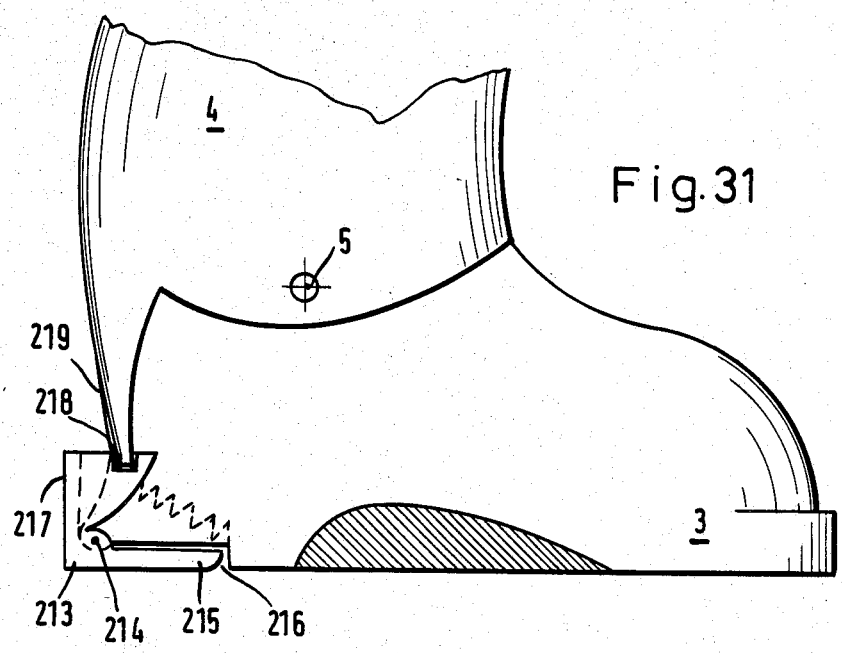
FIGS. 31 and 32 are corresponding, diagrammatic, side elevations of the foot and ankle portions of yet another modified form of a ski boot with release mechanism in accordance with the present invention, with parts in different positions and parts broken away.
Figure 32:
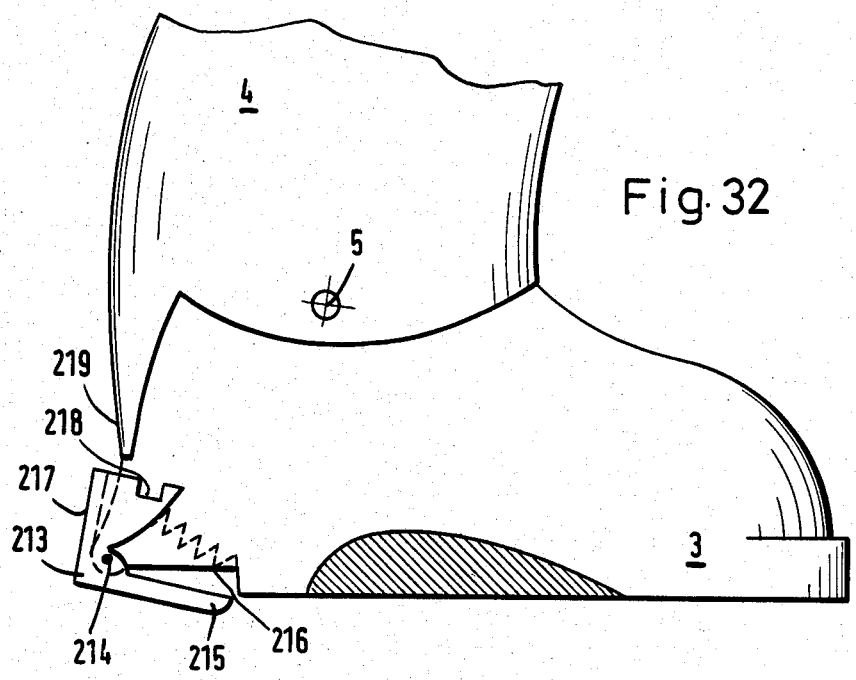

In the embodiment shown in FIGS. 31 and 32, the release member 213 is looped around the heel of the ski boot and includes an upward projecting portion 217 for engagement in the heel binding and a forward-extending portion 215 fitted in a recess 216 in the underside of the heel portion of the ski boot sole. The release member 213 is swingable about an axis 214 at the lower rear corner of the boot sole. The upward-projecting portion 217 of the release member has an upward-opening notch 218 normally receiving the downward-projecting retaining bar extension 219 of the boot ankle portion 4 so as to prevent swinging movement of the release member. When the ankle portion of the boot moves forward relative to the foot portion 3, however, the extension 219 swings out of the release member notch 218 so that the release member can swing inward, as shown in FIG. 32, to release the ski boot heel from the heel binding.

An additional advantage of the embodiment shown in FIGS. 31 and 32 is that, upon stepping back into the binding, the forward-extending portion 215 is swung upward to automatically swing the release member upward-extending portion 217 into the heel binding.

Figure 33:
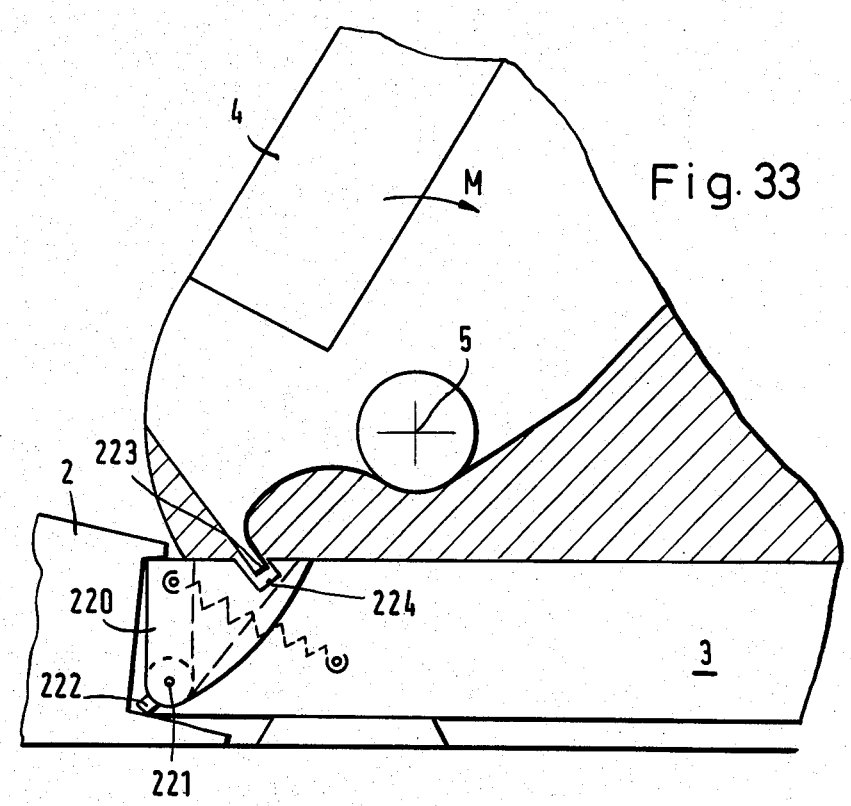
FIGS. 33 and 34 are corresponding, diagrammatic, side elevations of the heel portion of yet another modified form of a ski boot with release mechanism in accordance with the present invention and the upper surface and heel binding of a ski, with parts in different positions and parts broken away.
Figure 34:
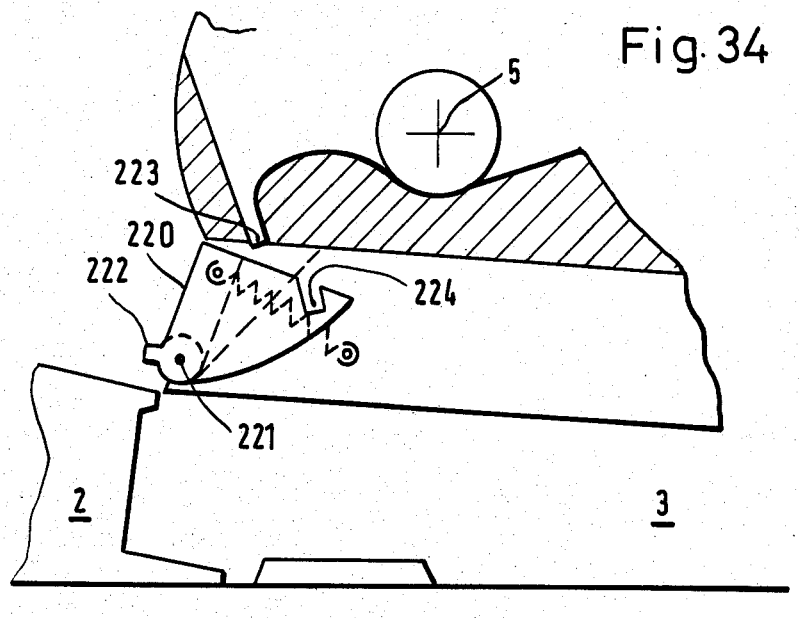

The embodiment shown in FIGS. 33 and 34 is similar to the embodiment shown in FIGS. 31 and 32. The release member 220 is looped around the heel portion of the ski boot sole and is pivoted to the sole for swinging about a transverse horizontal axis 221 located at generally the lower rear corner of the boot sole. A downward-projecting retaining bar extension 223 from the boot ankle portion 4 normally is fitted in a notch 224 in the upper side of the release member 220 to prevent swinging movement of the release member. Normally the upper rear portion of the release member is fitted in the heel binding 2, as indicated in FIG. 33. As also seen in FIG. 33, the release member 220 includes a downward and rearward extending projection 222 assuring that the release member is normally snugly held in the heel binding. When the moment M tending to swing the boot ankle portion 4 forward about the horizontal transverse axis 5 exceeds a predetermined moment, the extension 223 swings out of the release member notch 224 allowing the release member to swing forward to the position shown in FIG. 34, so that the heel of the boot can emerge upward out of the heel binding 2.

Figure 35:
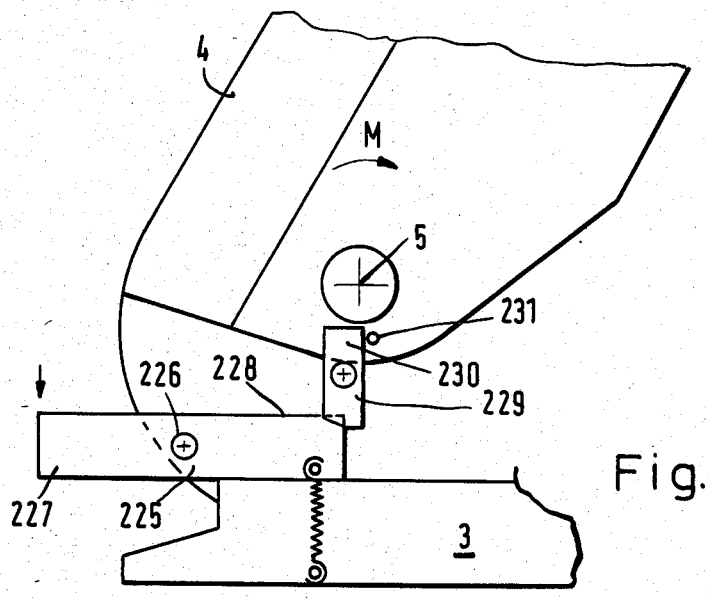
FIGS. 35 and 36 are corresponding, diagrammatic, side elevations of the heel portion of yet another modified form of a ski boot with release mechanism in accordance with the present invention, with parts in different positions and parts broken away.
Figure 36:
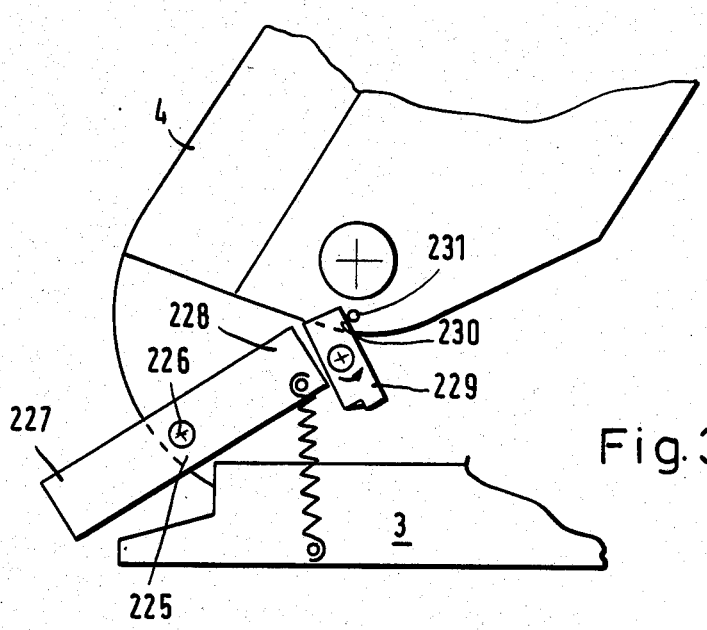

In the embodiment shown in FIGS. 35 and 36, the release member 225 is swingable about a horizontal transverse axis 226 through generally the heel region of the boot foot part 3. Such release member includes a rear portion 227 extending rearward beyond the ski boot sole and a forward-extending portion 228. A rotatable retaining bar 229 normally disposed in upright position, as shown in FIG. 35, is pivotally mounted on the boot foot portion 3 and prevents upward swinging of the forward end portion 228 of the release member 225 so as to retain the heel of the boot in the ski heel binding. Upon forward swinging movement of the boot ankle portion 4, however, a pin 231 carried by the ankle portion engages against the upper end portion 230 of the retaining bar and swings it counterclockwise, as diagrammatically indicated in FIG. 30, thereby releasing the release member.

Figure 37:
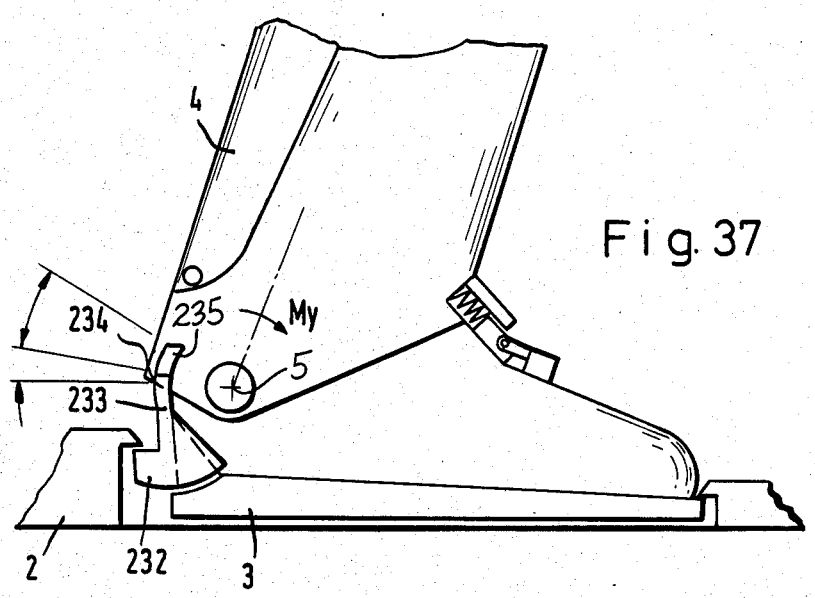
FIGS. 37 and 38 are corresponding, diagrammatic, side elevations of the foot and ankle portions of yet another modified form of a ski boot with release mechanism in accordance with the present invention and the upper surface and bindings of a ski, with parts in different positions.
Figure 38:
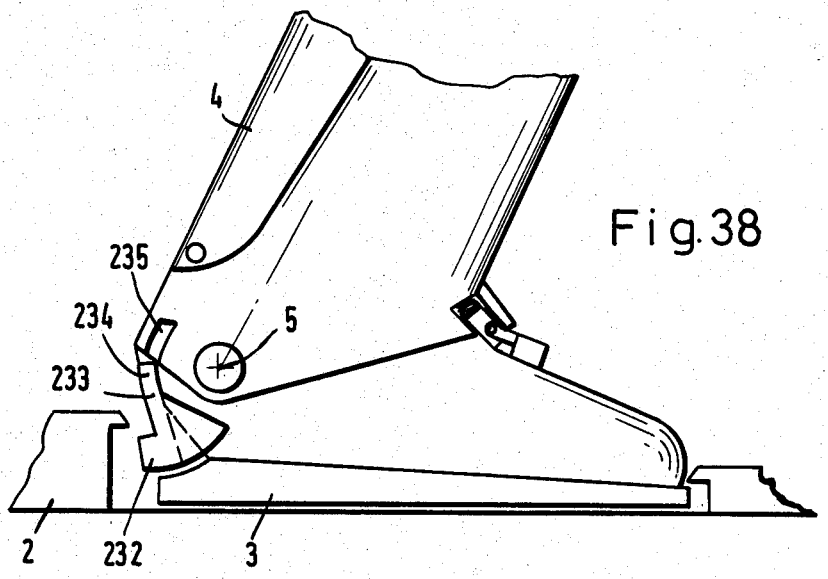

In the embodiment shown in FIGS. 37 and 38, the release member 232 is swingable about a horizontal transverse axis 233 in the heel region of the boot. The lower end portion of the release member normally is engaged in the heel binding 2, as shown in FIG. 37. The upper end portion 234 of the release member extends beyond the axis of rotation 233 and normally is fitted in an upright arcuate slot 235 in the retaining bar extension portion of the boot ankle portion 4. When the boot ankle portion swings forward to the position shown in FIG. 38, its slot 235 is swung out of engagement with the upper end portion 234 of the release member 233 so that the release member can swing counterclockwise as viewed in FIG. 38 to release the boot heel from the heel binding.

Figure 39:
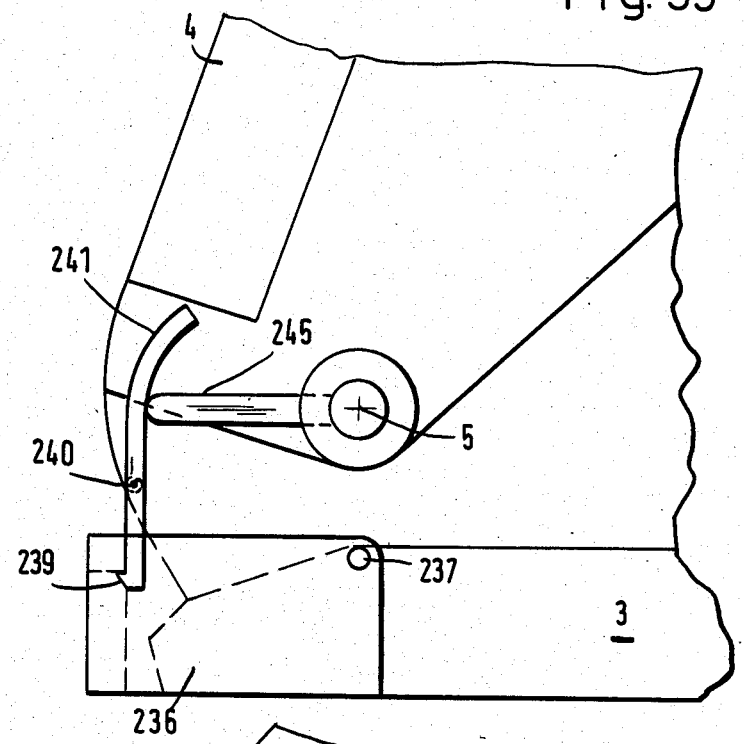
FIGS. 39 and 40 are corresponding, diagrammatic, fragmentary, side elevations of the heel portion of yet another modified form of a ski boot with release mechanism in accordance with the present invention, with parts in different positions.
Figure 40:
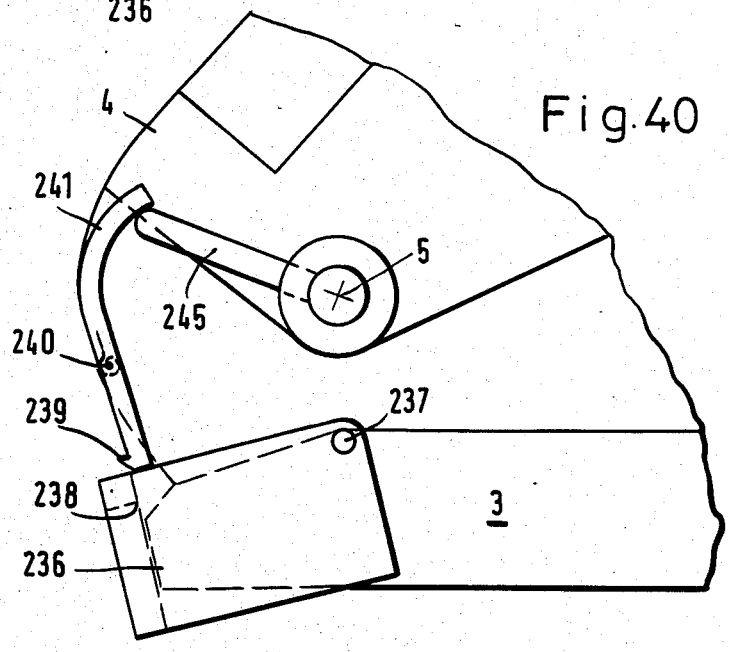

In the embodiment shown in FIGS. 39 and 40, similar to the embodiment shown in FIGS. 5 and 6, the release member 236 is a rigid U-shaped strip looped around the rear end of and extending rearward beyond the ski boot sole and swingable about a horizontal transverse axis 237 in generally the heel region of the boot. An upright retaining bar or lever 239 has a lower hooked end portion normally received in an undercut notch in the release member to prevent downward swinging of such member. Lever 239 is pivoted intermediate its ends for swinging about a horizontal transverse axis 240 at the rear of the boot foot portion 3. The upward-extending portion 241 of the control lever is curved forward alongside the boot ankle portion 4 to a position higher than the swinging axis 5 of such boot ankle portion. The ankle portion of the boot carries a release or latch lever 245, the rear end portion of which is engaged against the leading or forward edge of the retaining lever 239 to prevent swinging movement of the control lever. As indicated in FIG. 40, when the boot ankle portion 4 swings forward relative to the boot foot portion 3, however, the latch lever 245 swings with the ankle portion and forces the upper end portion 241 of the retaining lever rearward. The lower, hooked end portion of the retaining lever is swung forward to unlock the release member 236 and release the heel portion of the boot from the heel binding.

I claim:

1. In a ski boot fittable in a safety ski binding of a ski and having a foot portion, an ankle portion pivotally mounted on such foot portion for swinging about a horizontal transverse axis in the heel region of the boot and locking mechanism for deterring relative movement of such foot and ankle portions, the improvement comprising a release member pivotally mounted on the boot foot portion for swinging about the same horizontal transverse axis in the heel region of the boot between a locked position in which said release member is engaged in the binding for holding the ski boot on the ski and a released position in which said release member is out of engagement with the binding so as to release the boot from the ski, and control means carried by the boot for normally maintaining said release member in its locked position but actuatable by force in excess of a predetermined force being exerted on the boot to permit movement of said release member to its released position.

2. In the ski boot defined in claim 1, the improvement further comprising the control means being electrically actuated, and including an electric power source, and switch means closed by operation of the locking mechanism for connecting said power source and the electrically-actuated control means.

3. In the ski boot defined in claim 1, the improvement further comprising the control means being electrically actuated, and including an electric power source, and switch means closed by insertion of the ski boot into the binding for connecting said power source and the electrically-actuated control means.

4. In the ski boot defined in claim 1, the improvement further comprising the control means being electrically actuated, and including a battery for supplying electric power to the electrically-actuated control means, electronic visual display means carried by the boot for indicating the condition of the battery, and manually-operated switch means carried by the boot for actuating the electronic visual display means.

5. In the ski boot defined in claim 1, a second ski boot having the features specified therein, the control means of both boots being electrically actuated, both boots having electrical connection means for interconnecting the electrically-actuated control means of the two boots so as to assure simultaneous actuation of the two control means.

6. In the ski boot defined in claim 1, the control means being electrically actuated, force-sensing means mounted in the boot for signaling the electrically-actuated control means when the predetermined force is exceeded, said force-sensing means including means for detecting the moment tending to swing the boot ankle portion relative to the boot foot portion and for signaling the electrically-actuated control means when a predetermined moment is exceeded.

7. In the ski boot defined in claim 1, the boot foot portion including a bottom sole portion, and the release member being a yoke looped around the heel of the sole portion and extending rearward beyond the sole portion in locked position.

8. In the ski boot defined in claim 1, the control means including a retaining bar carried by the boot for movement relative thereto between a position blocking movement of the release member from its locked position and a position offset from the release member so as to allow it to move to released position, and retainer control means for normally maintaining said bar in its blocking position, said release member and said retaining bar having respective cooperating portions including a recess and a portion normally fitted in said recess in the locked position of said release member and the blocking position of said retaining bar.

9. In the ski boot defined in claim 1, the release member including a roller normally fitted in the ski binding.

* * * * *